United States Patent [19]

Koller

[11] 4,254,567

[45] Mar. 10, 1981

[54] CARD INDEX

[76] Inventor: Walter Koller, Beim Riesenstein 12, 2000 Hamburg 65, Fed. Rep. of Germany

[21] Appl. No.: 93,043

[22] Filed: Nov. 13, 1979

[51] Int. Cl.[3] ..... B42F 17/18

[52] U.S. Cl. ..... 40/389; 40/513; 40/532

[58] Field of Search ..... 40/389, 336, 532, 392, 40/393, 374, 375, 513; 209/610, 613

[56] References Cited

U.S. PATENT DOCUMENTS

| | | | |
|---|---|---|---|
| 3,818,622 | 6/1974 | Beger | 40/389 |
| 4,129,215 | 12/1978 | Halm | 40/389 X |

FOREIGN PATENT DOCUMENTS

| | | | |
|---|---|---|---|
| 2418112 | 10/1975 | Fed. Rep. of Germany | 40/389 |
| 2617725 | 1/1977 | Fed. Rep. of Germany | 40/389 |

*Primary Examiner*—John F. Pitrelli
*Attorney, Agent, or Firm*—H. Dale Palmatier

[57] ABSTRACT

A card index comprises a housing containing a drawer which holds a stack of punched cards. All the cards have punched holes in which a row of dogs in the bottom of the drawer engage and the cards also have punched selection holes in which selection stop cams can engage. Each card has selection holes in register with all of the stop cams except one. To select a card, a button corresponding to the card is pressed and this rocks a key lever to move the corresponding stop cam downwards. The cam passes through the selection holes in all the cards until it reaches the selected card which has no hole in register with that cam. Accordingly, the selected card and the cards, if any, below are pressed downwards and are held on the dogs. The drawer is released by depression of the button and is opened by a spring. As it opens, the drawer moves the cards which are pressed down on the dogs out of the housing with the selected card on top, but the cards above the selected card are retained in the housing by the stop cam. The arrangement has the great advantage over existing card indexes that it is not necessary to arrange the cards in any particular sequence in the stack in order for them to be correctly selected.

9 Claims, 9 Drawing Figures

CARD INDEX

This invention relates to card indexes comprising a housing having a drawer which is biased by a spring into an open position and which holds index cards having punched selection holes, selection key levers which have stop cams for engagement in the selection holes in the cards to hold some of the cards in the housing when the drawer is opened, a dog on the bottom of the drawer, all of the index cards having punched dog holes in which the dog engages to move those cards, which do not have their selection holes engaged by the stop cams, with the drawer as the drawer is opened, and a catch which holds the drawer closed but is released to allow the drawer to open upon operation of a selection key lever.

In one such card index, a dog is provided in the center of the bottom of the drawer and projects into registering punched dog holes, one in each card. The single dog is not high and has a relatively flatly inclined front edge. The stop cams are moved from below into the selection holes by pressing down the key levers so that the index cards which are to remain in the housing are held securely. The other index cards not held by the stop cam are moved out of the housing in the drawer by the single dog. With this arrangement, it can easily occur that individual cards which should be moved out in the drawer, get caught owing to the friction between the cards, or because of deformations. These cards are then not at all or only partially moved out of the housing, so that undesirable incorrect selections of the cards are obtained. Incorrect selections are also obtained if there are any errors in the sequence or positioning of the cards. This form of card index is disclosed in German Offenlegungsschrift No: 27 41 222.

The aim of the present invention is to provide a card index initially described in which incorrect selections of the cards are safely prevented. To achieve this, there are a row of dogs and these co-operate with the stop cams in a different way from that mentioned above.

According to this invention, in a card index as initially described there are a row of dogs; the stop cams are located closely in front of or between the dogs and are movable into the range of movement of the dogs; the dogs have inclined front edges facing in the direction in which the drawer opens to deflect the cards, which, in use, are engaged by a stop cam, upwards from the bottom of the drawer and all the index cards have selection holes which register with every stop cam except one so that when this one stop cam is moved by its selection key lever, the card which does not have a selection hole in register with the one stop cam together with the cards, if any, below it are held down by the stop cam on the dogs.

When the stop cam associated with a certain selected index card is moved downwards by its key lever, in the region of the selection holes it comes up against the selected card since this card does not have a selection hole in register with the associated stop cam. The stop cam thus prevents this index card and those, if any, under it from sliding off the dogs over the inclined edges of the dogs. In other words, the stop cam securely prevents the selected index card from being able to move off the dog whereas the cards lying above the selected card are stripped off the dogs without damage.

In one example, the drawer is provided with additional dogs which engage with the cards, which are not engaged by a stop cam, after the drawer has been partly opened. The additional dogs carry the card already selected and carried along by the first-mentioned dogs, completely out of the housing as the drawer is fully opened.

In another example, the dogs are supported pivotally on the drawer and have parts which engage with the housing as the drawer is opened to turn the dogs until the initially inclined front edges of the dogs are vertical, the parts and the engagement being such that the front edges become vertical before the dogs have moved out of the range of influence of the stop cams.

In this second example, the same dogs, owing to their pivoting, are made use of in order that when the index cards carried along by the dogs have left the range of influence of the stop cams they are further conveyed securely and completely out of the housing as the drawer is fully opened.

The selection holes and the dog holes which are sensitive to wear are not formed in the edges of the index cards, but may be situated only near one end of the card remote from the part of the card carrying information. It is very advantageous that the card index in accordance with the invention tolerates greater deviations in the stiffness and the flatness of the index cards, than is the case with existing card indexes. It is of particular importance that the index cards no longer need to be in particular arrangement or sequence in the drawer. Thus, the most frequent cause for incorrect card selections in card indexes is overcome.

Two examples of card indexes in accordance with the invention are illustrated in the accompanying drawings in which:

FIG. 7 is a longitudinal section through the rear end of a second example with the drawer pushed right in;

Figure 1:
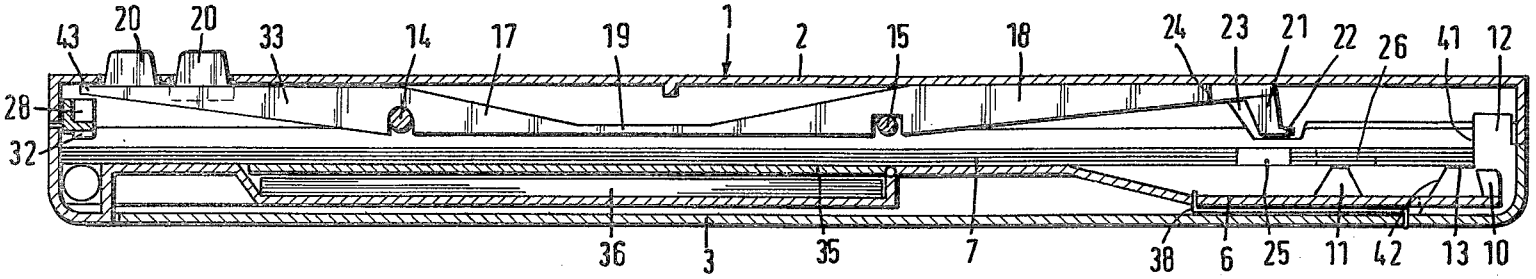
FIG. 1 is a vertical longitudinal section of one example in the closed position.
Figure 2:
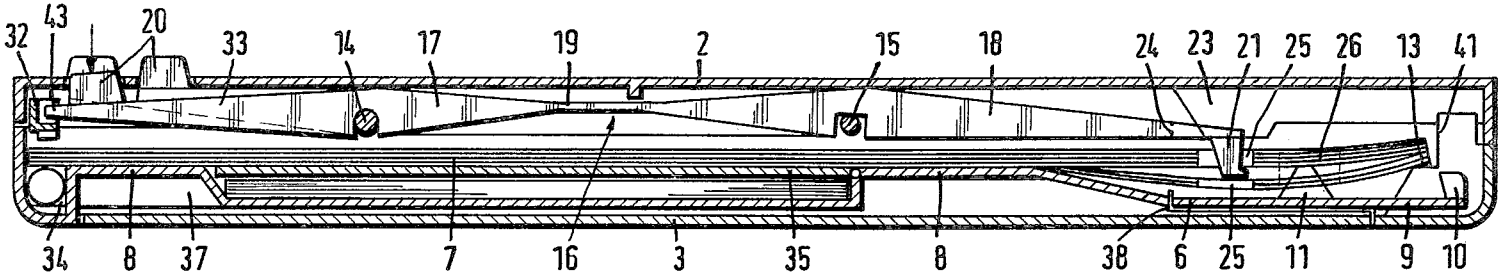
FIG. 2 is a view similar to FIG. 1 after a key has been pressed but the drawer has not yet been released.
Figure 3:
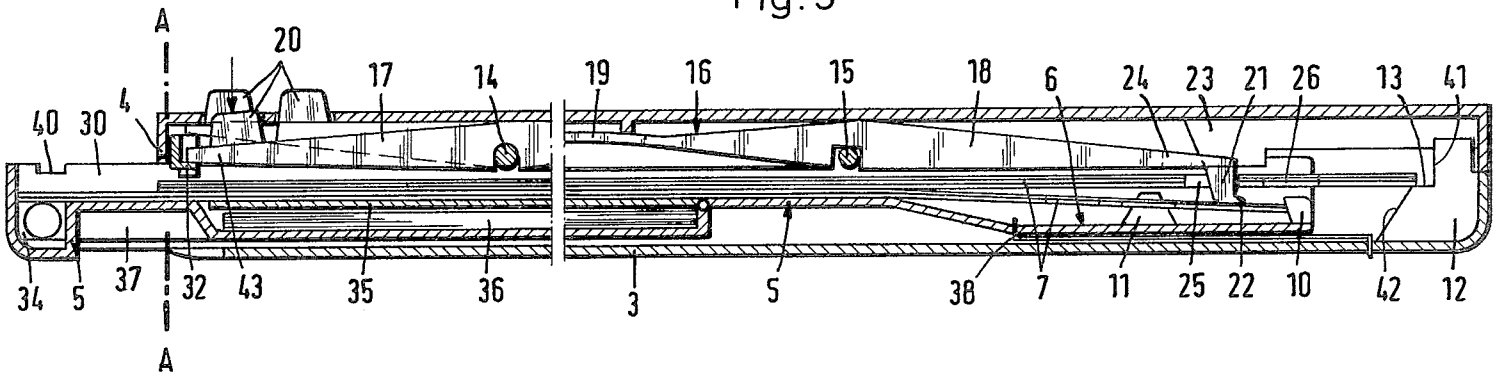
FIG. 3 is a view similar to FIG. 1 but with the drawer partially open.
Figure 4:
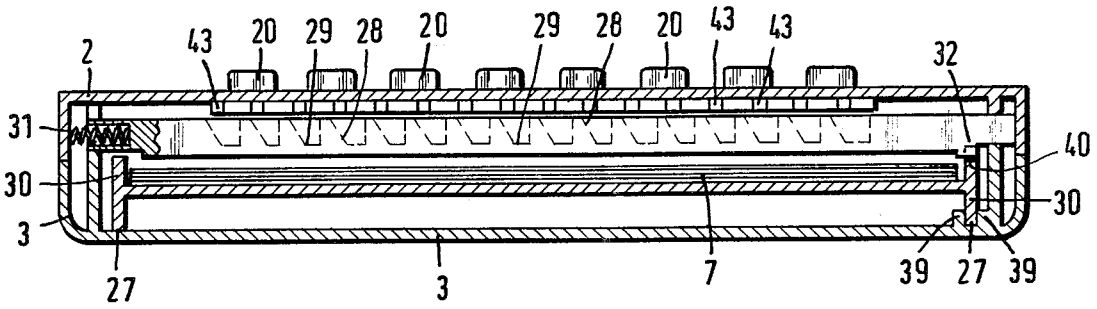
FIG. 4 is a cross section of the first example along the line A—A of FIG. 1.
Figure 5:
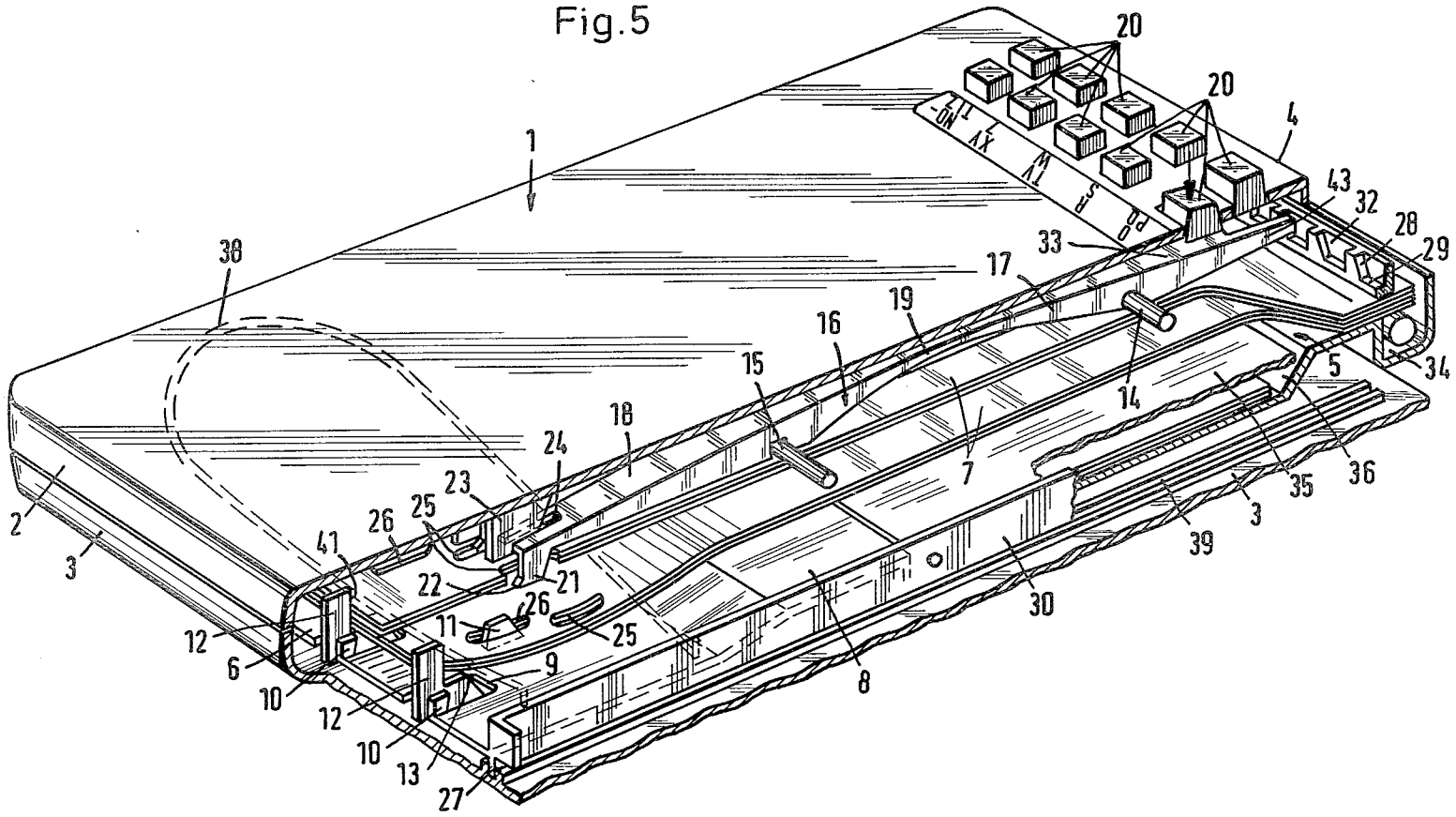
FIG. 5 is a perspective view of the first example showing part of the housing cut away longitudinally.
Figure 6:
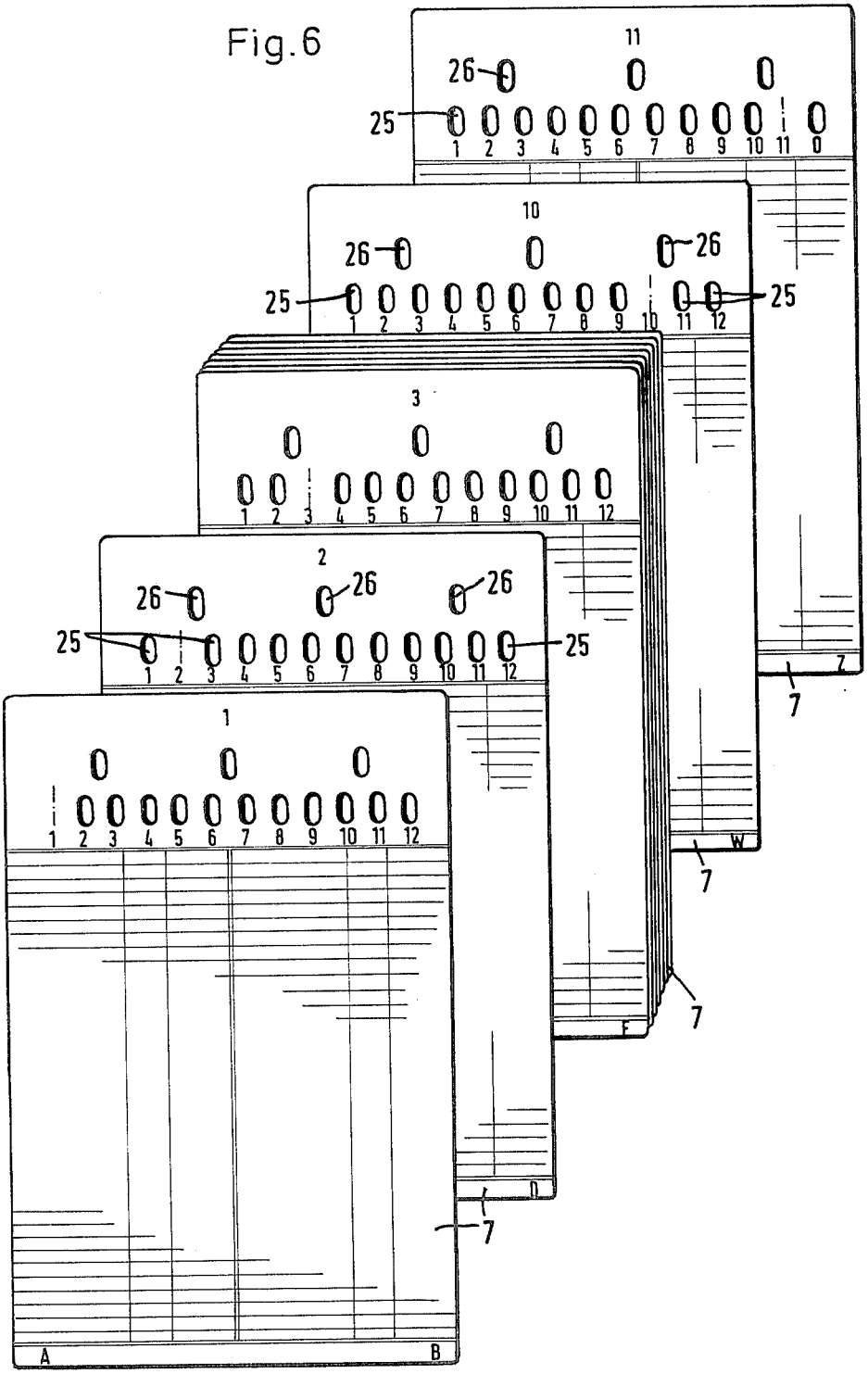
FIG. 6 is a perspective view of a pack of eleven punched index cards.

The first, preferred example comprises a housing 1 in which a drawer 5 is guided. The drawer is open towards the rear wall of the housing and is biased towards an open position by a tension spring 38. The drawer 5 has in its front part a ridge 8 extending across the whole width of the drawer and in its rear part, which lies lower in comparison with the raised front part, longitudinal slots 9 open towards the rear wall of the housing, as well as dogs 10 and auxiliary dogs 11 aligned in the longitudinal direction of the drawer 5.

Pillars 12 are fitted to the bottom 3 of the housing in such a way that with the drawer 5 closed they engage in the longitudinal slots 9. The pillars 12 are provided with bearing areas 13 which lie higher than the tips of the dogs 10.

The dogs 10 are preferably arranged one at one edge of each of some or all of the longitudinal slots 9 and run at a short distance from and parallel with the pillars 12. The front edges of the dogs 10 lie slightly behind a stop 41 on each pillar 12 and their tips lie below the plane of the bearing areas 13. Auxiliary dogs 11 are moulded onto the bottom 6 of the drawer in a row parallel with the pillars 12 and offset forwards from the dogs 10.

By means of the front ridge 8 in the drawer 5 and the arrangement of the pillars 12 with the bearing areas 13 it is achieved that the index cards 7 lie in a hollow in the region between the pillars 12 and the front ridge 8. The selected index cards can thereby be bowed downwards by the pressure cams 21 and seized by the auxiliary dogs 11.

Above the index cards 7 with the selection punched holes 25 and dog punchings 26, the arrangement of which is explained in more detail below, there are arranged in the housing 1 a number of key levers 16 each of which consists of two two-armed levers 17, 18 coupled one behind the other elastically. The levers 17, 18 can pivot about two axes 14 and 15 respectively and the free ends of the lever 16 terminate at one end in a button 20 and a key nose 43 and at the other end in a pressure cam 21, a stop nose 22 and a guide fork 24. The key levers 16 consisting of the two two-armed levers 17 and 18 coupled elastically one behind the other, may be made in one piece out of suitable springy material. But it is also possible and in certain circumstances advantageous to connect pivotally two separate two-armed levers, one end of one of which forms the button 20 and the key nose 43 and the one end of the other of which forms the pressure cam 21, stop nose 22 and guide fork 24. The connections may be effected by means of an adequately elastic connection piece 19, for example, of metal. For the production of one piece double levers relatively high quality material must be employed if these levers are to stand up to the permanent loading so that where necessary, a separate connection piece of, for example, spring steel may effect a saving in cost.

A card hold-down 23 on a cover 2 of the housing limits the free space for the index cards 7 and also, by means of the guide forks 24 on the key levers 16 guides the pressure cams 21.

The drawer 5 is kept closed by a bolt 32 which is guided parallel to the front edge of the housing 1 and is acted upon by a compression spring 31 which engages resiliently in a catch 40 made in one side cheek 30 of the drawer 5. For withdrawal of the bolt 32 there is arranged in the path of motion of each key nose 43 an oblique cam surface 28 the bottom end of which is made as a footrest 29 limiting the stroke of the key.

In the index cards 7 there are elongated selection punched holes 25 and also dog punched holes 26, which are also elongated, in two parallel rows. The number of the selection punched holes 25 under the pressure cams 21 is, on each index card 7, one less than the number of pressure cams 21, and in the row of selection punched holes of each index card 7 there is omitted the selection hole corresponding to a code number or code letter. The number of the dog punched holes 26 and the shape of these holes is the same in all of the index cards and corresponds with the number of auxiliary dogs 11.

To use the card index, the key 20 associated with the required index letter or symbol is pressed. The vertical stroke of the key 20 pivots the double armed lever 17 so that the elastic connecting piece 19 moves upwards and the double armed rear lever 18 pivots correspondingly about the axis 15. The bearing of the rear lever 18 on the axis 15 is made as an elongated slot to accommodate the slight longitudinal displacement which occurs. Thus the end of the key lever 16 which is guided downwards by the guide fork 22 against the card hold-down 23 drops under the key pressure and causes the associated pressure cam 21 to engage and lock in the associated selection punched holes until it comes against the index card to be selected, which has no selection punched hole at this point. The cam thus forces the selected card and the cards which happen to be lying underneath, over the auxiliary dogs 11. During the remainder of the stroke which the elastic deformation of the connection piece 19 allows, the drawer 5 is unbolted and owing to the spring 38, the drawer starts to open. The selected index card and the cards below it which are forced into engagement with the auxiliary dogs 11 are drawn out by the dogs 11 from under the index cards remaining in the index, the remaining index cards being locked in place by the pressure cam 21.

The auxiliary dogs 11 preferably have the shape of a truncated pyramid with rounded corners. Index cards which are not held down by the actuated pressure cam 21, if they engage erroneously, for example, by sagging into engagement with the auxiliary dogs 11 lying underneath, slide off the dogs because the slope of the effective flanks of the dogs brings this about. The selected index card and the cards below it, are prevented by the actuated pressure cam 21 from sliding off the dogs 11 and hence are carried along positively by the auxiliary dogs 11 as the drawer opens. When the selected index card, and the cards lying under it, are pressed down and move from the bearing areas 13 as the drawer opens, their ends bend down to the lowest part of the bottom 6 of the drawer because they are placed under stress by the pressure cams 21. They can then, when the auxiliary dogs 11 leave the hold-down region of the pressure cams 21, be engaged by the dogs 10 and move out with the drawer as the drawer opens. The dogs 10, as is clearly shown in the drawings, are undercut so that the cards are securely carried along by them and are held firmly. The index cards 7 held by the pressure cams 21 can only move forward by the extent which is permitted by the clearance between the rear edge of the selection punched hole 25 and the blocking edge of the pressure cam 21. This clearance is made smaller than the length of the bearing areas 13, so that the blocked index cards cannot slide off the pillars 12 and thus are held securely out of the field of engagement of the dogs 10 as the dogs pass under them. The distance between the dogs 10 and the pillars 12 is made so small that even sagging of the remaining cards between the bearing areas 13 on the individual pillars 12 cannot lead to their being engaged by the dogs 10. For the same purpose the bearing areas 13 on the pillars 12 lie somewhat higher than the tips of the dogs 10 beside them.

By the construction of the card index in accordance with the invention a considerable advantage is achieved as compared with known card indexes in that for the filing of the index cards 7 in the drawer 5 no definite arrangement or sequence has to be prescribed and card may be employed for the index cards which allows greater deviations as regards stiffness and hardness than is the case with known indexes. In this connection, it also has to be taken into consideration that cardboard is a "living" material which, for example, in the case of change in the humidity in the air easily warps, which in the case of the known index may lead to difficulties in the selection of the cards.

If the user removes his finger prematurely from the button 20 while the drawer is opening, the stop nose 22 on the pressure cam 21 catches under the rear edge of the selection punched hole 25 and prevents the blocking of the cards remaining in the housing from being released.

A predetermined elastic pre-stress of the connection piece 19 causes the neck 33 of each key and each pressure cam 21 with the guide fork 24 to rest against the housing cover.

A container 36 for notes or other paper slips, which in the preferred example is moulded under a part of the ridge 8 and is closed by a pivoted flap 35, and a channel 34 with a pencil are accessible if all of the index cards remain in the housing when the drawer is opened. To do this, the pressure cam 21 on one of the key levers 16 engages through holes in all of the index cards when the key is pressed. A recessed handle 37 connecting the container 36 and the channel 34 enables both a note slip and also the pencil to be grasped easily.

Upon closing the drawer 5 after the selection of a card, the following series of operations occurs:- the index cards 7 which have remained in the housing 1 move back until their rear edges strike against the stops 41 on the pillars 12. The stop nose 22 of the key lever 16 just used is thereby released from the selection holes in the cards in the housing and then the neck 33 and the cam 21 move upwards again against the housing cover 2. The selected index card, with the cards, if any, underneath it, while the drawer is still open, have their rear ends in the lower part 6 of the bottom of the drawer. As the drawer is pushed in, the rear edges of the index cards 7 are raised by the oblique guide surfaces 42 formed on the pillars 12 on to the bearing areas 13 and are thus taken out of engagement with the dogs 10 and the auxiliary dogs 11. At the same time the spring 38 is stressed and the compression spring 31 drives the bolt 32 into the catch 40 and thus locks the drawer 5 shut. After this, the index is ready for the selection of a new card by pressing another button 20.

Figure 7:
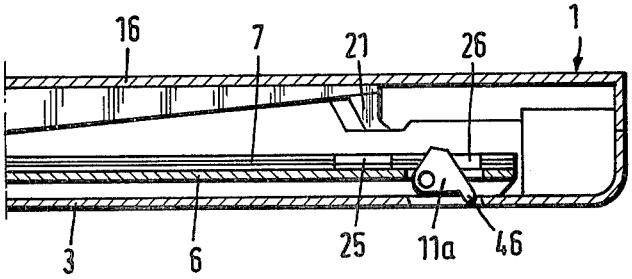
Figure 8:
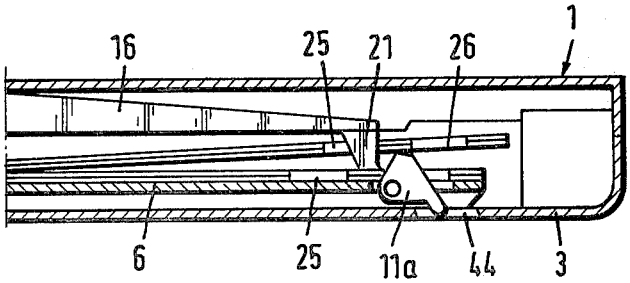
FIG. 8 is a section similar to FIG. 7, but after the pressing down of a key and after the drawer has opened slightly.
Figure 9:
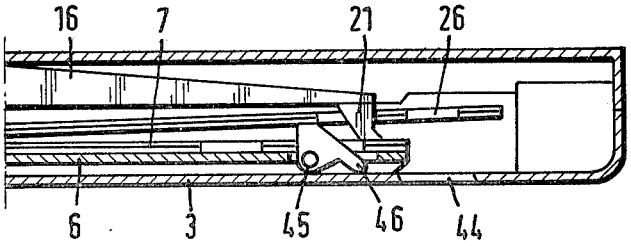
FIG. 9 is a section similar to FIGS. 7 and 8, but showing the drawer further open.

In the example of FIGS. 7 to 9, the same parts are designated by the same reference numerals. This example is different from the first example essentially in that the dogs 10 are omitted in the rear of the drawer. Furthermore, no recess is provided adjacent the rear of the drawer. The bottom 6 of the drawer is completely flat. Dogs 11*a* are supported pivotally at 45. On each dog there is a swinging nose which, in the closed position of the drawer (FIG. 7) lies in a slot 44 in the housing. The slot 44 is of such a length that the swinging nose 46 strikes against the end of the slot before the dogs have moved past the stop cams 21. In FIG. 8, this position has not yet quite been reached. In FIG. 9 the dogs 11*a* have already been turned by the nose 46 engaging the ends of the slot 44 so that the edges on the fronts of the dogs have now moved from their previously inclined positions into vertical positions and after leaving the range of influence of the stop cams the vertical edges of the dogs ensure the reliable carrying along of the selected index card and the cards below it, as the drawer is opened. After the pivoting motion of the dogs 11*a* has occurred, the key may be released.

In the example of FIGS. 7 to 9, the selected stop cam is moved downwards as in the first example until it comes into contact against the selected index card which has no selection punched hole in register with the cam. If the drawer is then moved forwards this index card and those lying underneath it are prevented from sliding up over the inclined front edge of the dog 11*a*. The other index cards lying above the selected card (see FIG. 8) are stripped off the dog 11*a* by the stop cam. When this stripping off is effected, the pivoting motion of the dog 11*a* is brought about so that the carrying along of the index cards is ensured by the front edges of the dogs 11*a* which are now upright.

I claim:

1. In a card index comprising a housing, a drawer slidably mounted in said housing, a stack of index cards in said drawer, spring means biassing said drawer to an open position from said housing, catch means holding said drawer closed in said housing, said index cards having punched selection holes and punched retaining dog holes, a plurality of selection key levers movably mounted in said housing, a stop cam for engagement in said selection holes on each of said key levers, means associated with key levers to release said catch means and allow said drawer to open when anyone of said key levers is operated, said stop cams being arranged to engage selectively in said selection holes whereby a selected card is allowed to move in said drawer on top of said stack out of said housing when a selected one of said key levers is operated, and dog means in said drawer engaging in said dog holes of said cards to move some of said cards with said drawer out of said housing as said drawer opens, the improvement wherein said dog means comprise a row of dogs, means locating said stop cams closely adjacent said dogs, said key levers being arranged to move said stop cams into a range of movement of said dogs, and means defining inclined front edges on said dogs facing in the direction in which said drawer opens from said housing, said inclined front edges being operative to deflect cards which, in use, have their selection holes engaged by one of said stop cams upwards away from the bottom of said drawer and off said dogs, and all of said index cards having selection holes which register with every stop cam except one stop cam so that when said one stop cam is moved by its key lever said card which does not have a selection hole in register with said one stop cam is held down by said stop cam on said dogs and is moved by said dogs with said drawer as said drawer is moved by said spring means from said housing.

2. A card index as claimed in claim 1, further comprising additional dogs in said drawer, said additional dogs being positioned to engage with said cards, which are not engaged by said stop cam, after said drawer has been partly opened.

3. A card index as claimed in claim 2, in which said additional dogs are positioned at the rear end of said drawer.

4. A card index as claimed in claim 2, further comprising means defining a row of longitudinal slots at the rear end of said drawer, a row of pillars, means fixing said pillars to the bottom of said housing, said pillars engaging in said longitudinal slots when said drawer is closed, means defining bearing areas on said pillars, said bearing areas supporting the rear ends of said index cards when said drawer is closed, said additional dogs being located adjacent to said pillars in a row parallel to said row of pillars, means defining stops for the rear edges of said cards on said pillars, and front edges of said additional dogs being located slightly behind said stops when said drawer is closed and said additional dogs including tips at a level below the level of said bearing areas.

5. A card index as claimed in claim 1, in which each of said key levers comprises a first two-armed lever, a second two-armed lever and means pivotally coupling said first two-armed lever to said second two-armed lever, and further comprising means pivotally mounting said first and said second two-armed levers about two axes which extend perpendicular to the direction of movement of said drawer as said drawer is opened and closed, a key mounted on the free end of said first two-armed lever and one of said stop cams being mounted on the free end of said second two-armed lever.

6. A card index as claimed in claim 5, in which said means coupling said first two-armed lever to said second two-armed lever comprises a resilient flexible member and means fixing said resilient flexible member to said first two-armed lever and to said second two-armed lever.

7. A card index as claimed in claim 1, further comprising means pivotally supporting said dogs on said drawer and said dogs including parts which engage with said housing as said drawer is opened, said parts being operative to turn said dogs until said inclined front edges of said dogs are vertical, said parts and the engagement of said parts with said housing being such that said front edges of said dogs become vertical before said dogs have moved out of the range of influence of said stop cams.

8. A card index as claimed in claim 7, in which said parts of said dogs are noses, and further comprising means defining slots in said housing, said noses extending into said slots when said drawer is closed and said noses engaging with ends of said slots to turn said dogs as said drawer is opened.

9. A card index as claimed in claim 1, in which said drawer includes first and second sides and said stop cams and said dogs are arranged symmetrically between said first and second sides of said drawer, and said index cards are provided on their under-sides with ruled lines extending in the direction of movement of said drawer as said drawer opens and closes.

* * * * *